US005450901A

United States Patent [19]

Ellwood

[11] Patent Number: 5,450,901

[45] Date of Patent: Sep. 19, 1995

[54] APPARATUS AND PROCESS FOR PRODUCING AND REINJECTING GAS

[75] Inventor: David E. Ellwood, Midland, Tex.

[73] Assignee: Marathon Oil Company, Findlay, Ohio

[21] Appl. No.: 169,857

[22] Filed: Dec. 17, 1993

[51] Int. Cl.[6] ..... E21B 43/18

[52] U.S. Cl. ..... 166/266; 166/268; 166/67; 166/105.5

[58] Field of Search ..... 166/263, 266, 267

[56] References Cited

U.S. PATENT DOCUMENTS

| | | | |
|---|---|---|---|
| 2,005,767 | 6/1935 | Zublin | 166/21 |
| 2,217,749 | 10/1940 | Hewitt | 166/266 |
| 2,238,701 | 4/1941 | McCollum | 166/266 |
| 2,357,703 | 9/1944 | Teichmann | 166/266 |
| 3,066,732 | 12/1962 | McEver | 166/266 |
| 3,223,157 | 12/1965 | Lacey et al. | 166/266 |
| 3,247,798 | 4/1966 | Glasgow et al. | 103/6 |
| 3,580,336 | 5/1971 | Meldau | 166/267 |
| 3,965,983 | 6/1976 | Watson | 166/250 |
| 4,223,728 | 9/1980 | Pegg | 166/267 |
| 4,241,787 | 12/1980 | Price | 166/105 |
| 4,296,810 | 10/1981 | Price | 166/265 |
| 4,345,734 | 8/1982 | Studinger | 248/669 |
| 4,697,642 | 10/1987 | Vogel | 166/266 |
| 5,133,407 | 7/1992 | Delnes et al. | 166/267 |

*Primary Examiner*—Ramon S. Britts
*Assistant Examiner*—Frank S. Tsay
*Attorney, Agent, or Firm*—Jack L. Hummel; Jack E. Ebel

[57] ABSTRACT

An apparatus and process for separating and producing gas and liquid from a subterranean production zone via a well in fluid communication with the zone. After separation in the well, the gas is produced to the surface, compressed, and injected into an injection zone which is also in fluid communication with the well. The liquid is pumped to a production facility at the surface.

28 Claims, 2 Drawing Sheets

APPARATUS AND PROCESS FOR PRODUCING AND REINJECTING GAS

FIELD OF THE INVENTION

This present invention relates generally to fluid production from subterranean wells, and in particular to an apparatus and process for producing fluid from a subterranean formation into a well, separating the fluid into gas and liquid in the well, producing the gas to the surface, and then compressing and reinjecting the gas into a subterranean formation.

BACKGROUND OF THE INVENTION

When fluids are produced from a petroleum well, gas and liquids are frequently separated at a production facility serving the entire field or a group of wells. Other functions occurring at production facilities include gas processing and compression. Compressed gas may then be reinjected into a subterranean formation.

Oil with a high gas to oil ratio (GOR) increases the handling costs for production facilities and gas injection systems. In some fields, the available gas compression capacity of the production facility or regulations restricting the quantity of gas that can be produced limit the total number of wells in production. Thus, if a portion of the gas from a high GOR well can be separated before the produced hydrocarbons reach the production facility, the effective GOR can be lowered, and other previously shut-in wells elsewhere in the field can be produced or the volume of oil which is permitted to be produced from a well can be increased.

In an oil field undergoing pressure maintenance operations, compressed produced gas can be injected into the same reservoir from which fluids are produced. In other situations, disposal of gas produced at isolated wells can pose a problem where it is uneconomical to tie into a gas gathering system or where other gas handling systems are nonexistent or uneconomical. It has been a common practice to flare excess produced gas to eliminate the need for gathering or handling facilities. However, this practice wastes a valuable natural resource and is increasingly prohibited by environmental regulations. An alternative to flaring gas is to inject it into a different subterranean formation for storage and possible subsequent retrieval.

For high liquid production, an alternative to separation at the production facility is the use of a downhole submersible separator/compressor. However, submersible separator/compressors have a history of high failure rates in high GOR wells. Also, the gas compressor section of a submersible pump can be damaged if liquids enter it.

Thus, there is a need for a means to reduce the GOR in high GOR wells to decrease loading of gas handling facilities. There is also a need to provide an efficient system for reinjecting produced gas for pressure maintenance or for storage at wells where gas handling facilities are unavailable or uneconomical to construct. An additional need is to comply with environmental regulations that prohibit flaring of unwanted produced gas. A further need is to reduce waste of a natural resource.

For the foregoing reasons, there is a need for a wellsite compression/injection process in which produced gas is separated from liquid, for example, oil, in a high GOR-well, prior to reaching production facilities, and then compressed and reinjected via the well into a subterranean formation.

Accordingly, a primary object of the present invention is to reduce the GOR ratio in high GOR wells to decrease the loading of gas handling facilities.

Another object of the present invention is to provide an efficient system for reinjecting produced gas for pressure maintenance in a gas-drive reservoir.

A further object of the present invention is to provide a system for storing of gas produced at wells where gas handling facilities are unavailable or uneconomical to construct.

Yet another object of the present invention is to provide a means for storage of unwanted produced gas in compliance with environmental regulations prohibiting flaring.

Another object of the present invention is to reduce waste of produced gas, a natural resource.

SUMMARY OF THE INVENTION

To achieve the foregoing and other objects, and in accordance with the purposes of the present invention, as embodied and broadly described herein, one characterization of the present invention comprises an apparatus for separating gas and liquids produced from at least one subterranean production zone in fluid communication with a cased well and reinjecting the gas into at least one subterranean injection zone in fluid communication with the well. The well penetrates and is in fluid communication with at least one subterranean injection zone and at least one production zone. The invention includes means for separating gas and liquids within the well and means for producing gas from the production zone to the surface, compressing the gas at the surface, and reinjecting the gas into said subterranean injection zone. There is a production tubing string within the well and a means for pumping liquid through the production tubing string to the surface.

Another characterization of the present invention provides a process for separating gas and liquids produced from at least one subterranean production zone in fluid communication with a cased well and reinjecting the gas into at least one subterranean injection zone in fluid communication with the well. The pressure in the well is reduced to a value less than the production zone pressure, thereby causing fluids to flow into and separate within the well into gas and liquid. The gas is produced to the surface, compressed, and reinjected into the subterranean injection zone. A liquid pumping means pumps the liquid through a production tubing string to the surface.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

In the following discussion, the term "GOR" refers to the ratio of gas to liquid. The liquid may be oil, water, another substance, or a mixture of substances.

Figure 1:
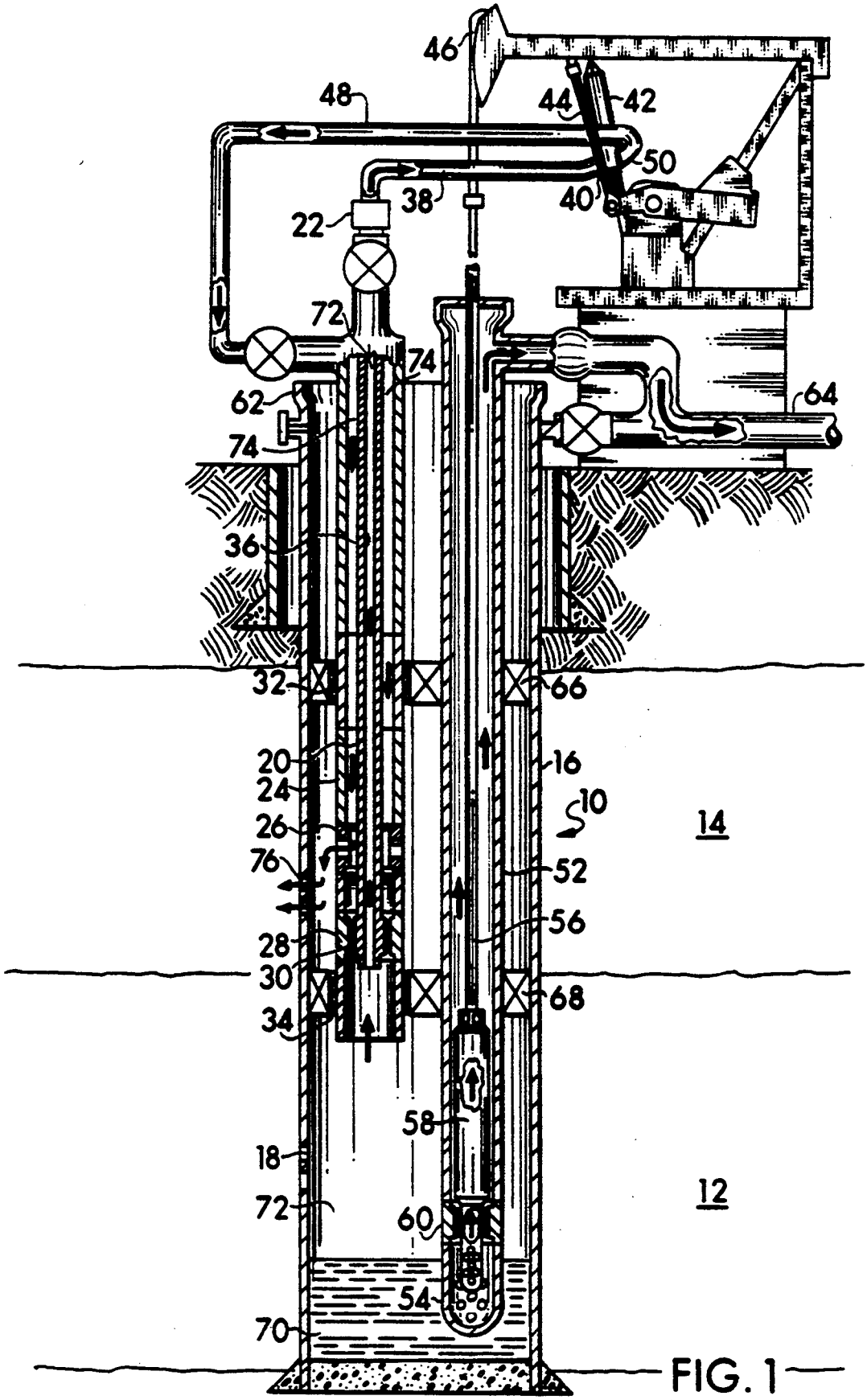
FIG. 1 is a partially sectioned, perspective view illustrating one embodiment of the invention, partially sectioned to show a well extending through an injection zone and a production zone.

Referring to FIG. 1, a well 10 traverses a plurality of subterranean formations, including at least one production zone 12 and at least one injection zone 14. According to methods known to those skilled in the art, the well is fitted with a casing 16, and the casing is pierced by production perforations 18 adjacent to the production zone 12 and injection perforation 76 adjacent to the injection zone 14.

A string of siphon tubing 20 is positioned inside a string of injection tubing 24. Both the siphon tubing 20 and the injection tubing 24 are hung inside the well casing by hanger and seal assembly 22. Injection tubing 24 includes one or more ported seating nipples 26 adjacent the injection zone 14. A seating nipple 28 at the lower end of the siphon tubing is seated in a seat assembly 30 and seals a first annulus 36 between the siphon tubing 20 and the injection tubing 24. Dual packers 66 and 68 isolate the production and injection zones 12 and 14. Tubing/packer seal assemblies 32 and 34 form a seal between the dual packers 66 and 68 and the injection tubing 24, functioning to isolate the production zone 12 and the injection zone 14.

At the surface, a produced gas line 38 connects the siphon tubing 20 to a compressor inlet 40 of a gas compressor 42 mounted on the walking beam 44 of a rod pumping unit 46. A compressed gas line 48 connects a compressor outlet 50 to the annulus 36 defined between the injection tubing 24 and the siphon string 20.

A string of production tubing 52 is also hung inside the casing 16, extending into the portion of the well adjacent to the production zone 12 and proximate the bottom of the well, and terminating in a perforated tubing nipple 54. Alternatively, the production tubing 52 and the production zone 12 could be proximate a plug in the well. Inside the production tubing is a sucker rod string 56 connecting the rod pumping unit 46 at the surface to an insert liquid pump 58 near the bottom of the well. The insert pump is seated on a seating nipple 60 inside the production tubing. The production tubing is connected at the wellhead assembly 62 to a pipeline 64 leading to a fluid handling facility, not shown.

The present invention also comprises a process for separating gas from liquid in the well, compressing the gas at the wellhead, and reinjecting the gas into a subterranean formation. The pump 58 and the compressor 42 maintain pressure in the well 10 at a level less than the pressure in the production zone 12. The compressor 42 also maintains a lower pressure than the pump 58. Thus, fluids from production zone 12 of the subterranean formation enter the interior of the casing 16 via production perforations 18. As a result of the pressure decrease in the well, the fluids separate into a layer of liquid 70 underlying a layer of gas 72 inside the casing. Gas from the gas layer 72 is produced through the siphon tubing 20 to the surface and into the compressor inlet 40 of the gas compressor 42 mounted on the walking beam of the rod pumping unit 46. Compressed gas 74 flows from the compressor outlet 50, through the compressed gas line 48, and into the annulus 36 between the siphon tubing 20 and the injection tubing 24. Expansion of the compressed gas results in gas injection through one or more ported seating nipples 26 and through injection perforations 76 in casing 16 into the injection zone 14.

Liquid 70 from an accumulation at the bottom of the well enters the production tubing 52 through a perforated tubing nipple 54. The liquid can be any liquid, although, in most cases, it will be oil, water, or a combination of oil and water, possibly containing some entrained or dissolved gas. Reciprocal motion of pumping unit 46 is transferred through sucker rods 56 to insert liquid pump 58, causing liquid to be pumped from accumulation 70 through the production tubing to the surface, where the liquid flows through the wellhead assembly 62 into the pipeline 64 leading to the production facility.

Figure 2:
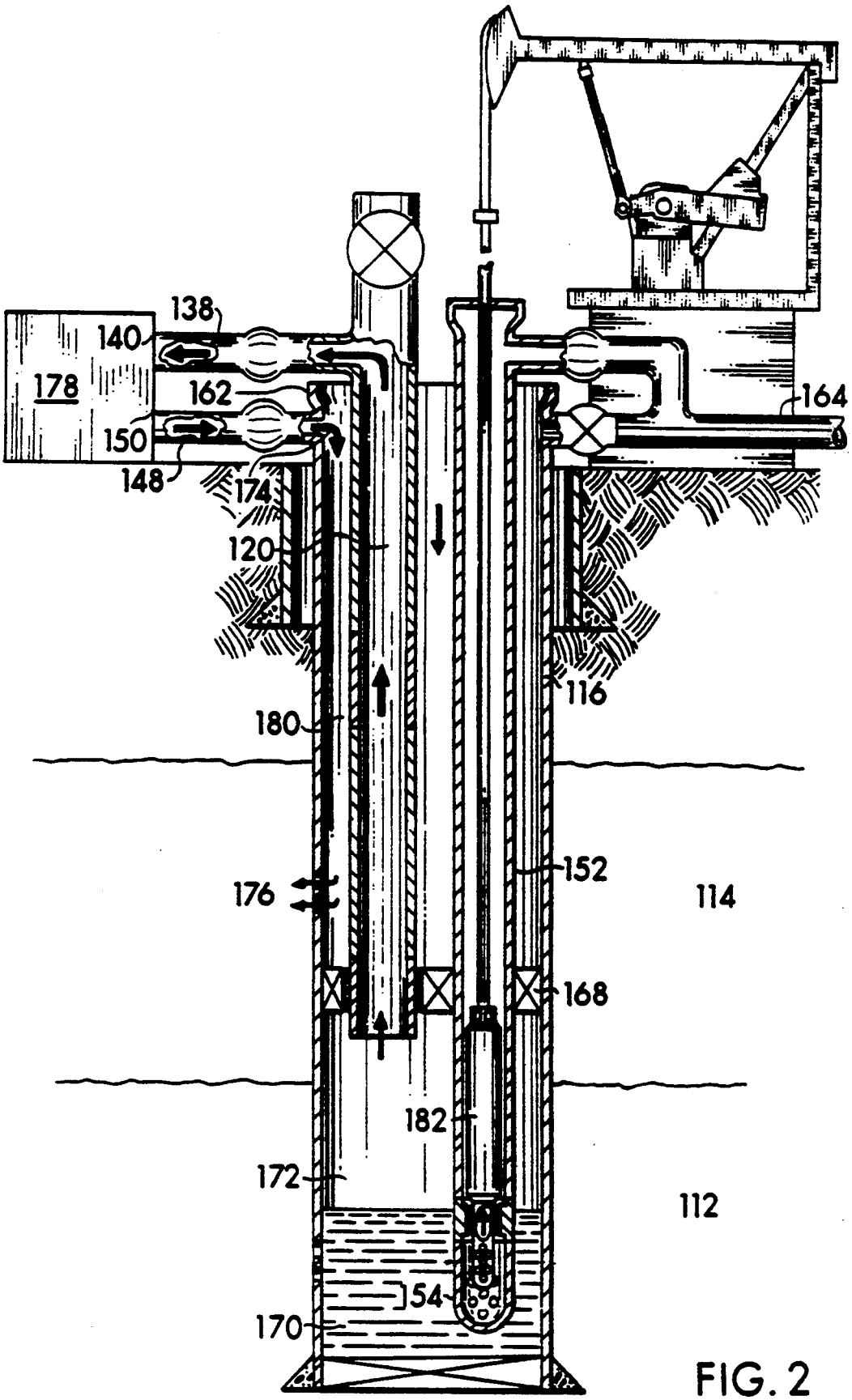
FIG. 2 is a partially sectioned, perspective view illustrating another embodiment of the present invention, partially sectioned to show another well extending through an injection zone and a production zone.

An alternative embodiment of the invention is shown in FIG. 2. Gas 172 flows from a production zone 112 through siphon tubing 120 and a siphon gas line 138 to a compressor inlet 140 of a skid-mounted gas compressor 178. Compressed gas 174 leaves a compressor outlet 150 and flows through a compressed gas line 148 to a wellhead assembly 162. The gas then passes into an annulus 180 between the siphon tubing 120 and the casing 116 and is injected into an injection zone 114 through injection perforations 176 in casing 116. A dual packer 168 isolates the section of the well adjacent to the production zone 112.

Liquid 170 which accumulates at the bottom of the well enters the production tubing 152 through a perforated tubing nipple 154. A tubing liquid pump 182 is mounted on the tubing and pumps the liquid through the production tubing to the surface, where the liquid flows through the wellhead assembly 162 into a pipeline 164 leading to a production facility.

Preferably, the total gas and liquid produced in a well prior to applying the process of the present invention does not exceed about 1,000 barrels per day, and the GOR of the produced gas and liquid is greater than about 300 mcf per day per barrel of liquid.

Thus, the present invention can be used to reduce the GOR ratio in high GOR wells to decrease the loading of gas handling facilities. The invention provides an efficient system for reinjecting produced gas for pressure maintenance in a gas-drive reservoir. The invention also provides a system for storing gas produced at wells where gas handling facilities are unavailable or uneconomical to construct. In addition, the present invention provides a means for storing unwanted produced gas in compliance with environmental regulations prohibiting flaring. The present invention also helps to reduce waste of produced gas, a natural resource. Thus, the present invention results in improved gas handling efficiency.

Although the present invention has been described in considerable detail with reference to certain preferred embodiments thereof, other embodiments are possible.

As is apparent to one skilled in the art, there may be a plurality of production zones or a plurality of injection zones in accordance with this invention. Each injection zone may be in the same geological formation as a production zone. For example, gas injection may be used to maintain pressure in a gas-drive reservoir. Alteratively, each injection zone may be in a different and distinct geological formation from each production zone. For example, gas injection may be for the purpose of gas storage.

In accordance with this invention, any suitable liquid pump can be used. The preferred type of liquid pump is a rod pump. Alternatively, a submersible pump may be used. However, the latter type of pump occupies more space in the well and may not leave an adequate volume for separation of gas and liquids in the well. The preferred rod pump can be either a tubing pump or an insert pump. An insert pump is easier to service, but a tubing pump may have a higher capacity.

It should be noted that any gas compressor located in the vicinity of the wellhead is in accordance with this invention. The compressor should be capable of lowering the pressure to a value below about 100 psi inside the casing adjacent to the production zone. A compressor mounted on the walking beam of a rod pumping unit is preferred because it does not require a fuel source in addition to that used to operate the liquid pump. However, the compression ratios obtainable with commercially available beam mounted gas compressors, such as those provided by Permian Production Equipment of Midland, Tex., are limited to a maximum of about 6:1. If a greater compression ratio is required, one or more compressors of another type, such as skid-mounted reciprocal or turbine compressors, can be used.

As will be evident to a skilled artisan, any scheme can be used for isolating the production zone and the injection zone from each other. The injection zone should be cased, and it is preferable if the entire well is cased. The producing zone may be above or below the injection zone, and the zones may be separated by one or more other zones. Also, the process and apparatus of the present invention can be applied to more than one production zone or more than one injection zone. Also according to the present invention, tubing configurations other than those illustrated in FIGS. 1 and 2 are possible. For example, the siphon tubing and the injection tubing need not be concentrically arranged.

While the foregoing preferred embodiments of the inventions have been described as shown, it is understood that the alternatives and modifications, such as those suggested and others, may be made thereto and fall within the scope of the invention.

I claim:

1. An apparatus for separating gas and liquids produced from at least one subterranean production zone in fluid communication with a cased well and reinjecting the gas into at least one subterranean injection zone in fluid communication with the well, the apparatus comprising:

a) means for separating gas and liquid within the well;
b) means for producing gas from the production zone to the surface;
c) means for compressing the gas at the surface;
d) means for reinjecting the gas into the subterranean injection zone;
e) a production tubing string within the well; and
f) means for pumping liquid through the production tubing string to the surface.

2. The apparatus of claim 1 wherein the liquid is piped to a production facility.

3. The apparatus of claim 1 wherein said means for producing gas from the production zone to the surface is a siphon tubing string within the well.

4. The apparatus of claim 1 wherein said means for compressing said gas is mounted on the walking beam of a rod pumping unit and powered by the motion of the beam.

5. The apparatus of claim 3 wherein said means for reinjecting said gas into said subterranean injection zone is an annulus between said siphon string and casing which is positioned in the well.

6. The apparatus of claim 1 wherein said means for reinjecting said gas is an injection tubing string.

7. The apparatus of claim 6 wherein said injection tubing string is outside and concentric with said siphon tubing string and said gas is injected via an annulus between the siphon tubing and the injection tubing and via openings in the injection tubing and perforations in casing which is positioned in the well.

8. The apparatus of claim 1 wherein said production and injection zones are in substantially the same subterranean formation.

9. The apparatus of claim 1 wherein said production and injection zones are in different and distinct subterranean formations.

10. The apparatus of claim 1 wherein said compressed gas is reinjected into a plurality of injection zones.

11. The apparatus of claim 1 whereby said gas is produced from a plurality of production zones.

12. The apparatus of claim 1 wherein said means for compressing gas is capable of maintaining a pressure less than about 100 pounds per square inch inside the well casing adjacent to said production zone.

13. The apparatus of claim 1 wherein said liquid pumping means is a submersible pump.

14. The apparatus of claim 1 wherein said liquid pumping means is driven by a rod pumping unit.

15. The apparatus of claim 14 wherein said liquid pumping means is a tubing pump.

16. The apparatus of claim 14 wherein said liquid pumping means is an insert pump.

17. The apparatus of claim 1 wherein said means for separating gas and liquids comprises a section of casing adjacent the production zone, the section containing an interior space within which fluids collect and separate into a gas layer and a liquid layer underlying the gas layer.

18. A process for separating gas and liquids produced from at least one subterranean zone in fluid communication with a cased well and reinjecting the gas into at least one subterranean injection zone in fluid communication with the well, the process comprising:

a) causing fluids to flow into and separate within the well into gas and liquid by reducing the pressure in the well to a value less than the production zone pressure;
b) producing the gas to the surface;
c) compressing the gas;
d) reinjecting the gas through the same well into the subterranean injection zone; and
e) pumping the liquid through a production tubing string to the surface with a liquid pumping means.

19. The process of claim 18 whereby said liquid is pumped to a production facility.

20. The process of claim 18 whereby said injection zone and said production zone are in substantially the same subterranean formation.

21. The process of claim 18 whereby said gas is injected into an injection zone in a different and distinct subterranean formation than that from which it was produced.

22. The process of claim 18 whereby said gas is reinjected into a plurality of injection zones.

23. The process of claim 18 whereby said gas is produced from a plurality of production zones.

24. The process of claim 18 whereby said gas is produced via a siphon string in the well.

25. The process of claim 24 whereby said compressed gas is injected into said subterranean injection zone via an annulus between said siphon string and said well casing.

26. The process of claim 18 whereby said compressed gas is injected into said subterranean injection zone via an injection tubing string.

27. The process of claim 18 whereby the total fluid production rate is less than about 1,000 barrels per day.

28. The process of claim 18 whereby the GOR of the produced fluid is greater than about 300 mcf per day per barrel of oil per day.

* * * * *